United States Patent [19]

Fukuroi

[11] 4,349,953

[45] Sep. 21, 1982

[54] METHOD OF MANUFACTURING SLIDE FASTENER COUPLING ELEMENTS

[75] Inventor: Takeo Fukuroi, Uozu, Japan

[73] Assignee: Yoshida Kogyo Kabushiki Kaisha, Tokyo, Japan

[21] Appl. No.: 132,981

[22] Filed: Mar. 24, 1980

[51] Int. Cl.[3] ..... B21D 53/50

[52] U.S. Cl. ..... 29/410

[58] Field of Search ..... 29/33.2, 410, 766, 769, 29/408; 24/205.13 R; 113/116 V, 116 Y; 72/356, 357, 360, 377

[56] References Cited

U.S. PATENT DOCUMENTS

| | | | |
|---|---|---|---|
| 2,060,141 | 11/1936 | Ulrich | 29/410 |
| 2,612,795 | 10/1952 | Kaufmann | 29/410 X |
| 2,622,295 | 12/1952 | Mikulas | 29/410 X |
| 2,685,127 | 8/1954 | Kaufmann | 29/410 |
| 3,136,046 | 6/1964 | Chery | 29/410 |
| 4,055,882 | 11/1977 | Yoshida | 29/410 |

*Primary Examiner*—Ervin M. Combs

*Attorney, Agent, or Firm*—Robert E. Burns; Emmanuel J. Lobato; Bruce L. Adams

[57] ABSTRACT

A metal strip including an elongate web and a pair of longitudinal medial lands on both sides thereof, is successively stamped or coined so as to be provided with a series of coupling elements each including on each of its both sides a transverse projection and a pair of longitudinal teeth one on each side of the projection, the projection being higher than the teeth. The projection and teeth are formed from material of the medial lands and additionally from material of a portion extending all the way around the projection and teeth, which is thinned down to a thickness smaller than that of the web. Then, the metal strip is notched along its marginal edges to provide the outer profile of clamping legs, and is severed into individual coupling elements.

2 Claims, 10 Drawing Figures

METHOD OF MANUFACTURING SLIDE FASTENER COUPLING ELEMENTS

BACKGROUND OF THE INVENTION

1. Field of the Invention

The present invention relates to a method of manufacturing slide fastener coupling elements successively from a metal strip by coining and blanking.

2. Prior Art

A variety of methods have been known to produce so-called double-acting or two-way coupling elements for side fasteners. U.S. Pat. No. 2,622,295, issued Dec. 23, 1952 discloses one form of such double-acting coupling elements, which are manufactured by roll-coining a wire stock in a manner as described in U.S. Pat. No. 2,201,068, issued May 14, 1940. The rolling method is disadvantageous in that the rolled wire stock must be reversed in its direction of feed when severed and attached to the beaded edge of a stringer tape, resulting in an increased expenditure of time and labor.

U.S. Pat. No. 3,136,046, issued June 9, 1964 shows a metal strip having longitudinal medial raised portions which are deformed by a punch press into longitudinally spaced coupling projections. With this arrangement, the projections thus produced are of a relatively low profile owing to their height being virtually dependent on the height of the medial lands, and hence the metal strip must be considerably thick for the projections to have a required projection height.

SUMMARY OF THE INVENTION

According to the present invention, a metal strip including a web having longitudinal medial lands on its both sides is stamped to deform a portion of each of the medial lands substantially into a transverse projection and a pair of longitudinal teeth one on each side of the projection, and simultaneously a pocket portion surrounded by and a base extending around the projection and teeth are stamped so as to be thinner than the web with material from the pocket portion and base flowing into the projection and teeth. Accordingly, the projection and teeth are of a relatively high profile regardless of a reduced thickness of the web. Tape-clamping legs of coupling elements are then blanked out of the web.

It is an object of the present invention to provide a method of manufacturing double-acting slide fastener coupling elements having sufficiently high coupling projections from a relatively thin metal strip.

Another object of the present invention is to provide a method of manufacturing such coupling elements having relatively thin tape-clamping legs for smooth movement of a slider thereon.

Still another object of the present invention is to provide a material-saving method of manufacturing double-acting slide fastener coupling elements.

The above and other objects, features and advantages of the present invention will become apparent from the following description when taken in conjunction with the accompanying drawings which illustrate a preferred embodiment by way of example.

DETAILED DESCRIPTION

Figure 1:
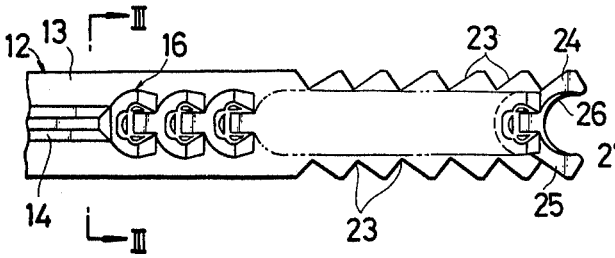
FIG. 1 is a plan view of a metal strip as it is coined and punched before being severed into individual coupling elements.
Figure 3:
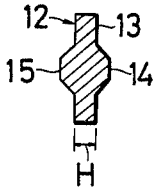
FIG. 3 is a cross-sectional view taken along line III—III of FIG. 1.

As shown in FIGS. 1 and 3, a coupling element blank is in the form of a metal strip 12 comprising an elongate web 13 and a pair of longitudinal medial lands 14,15 on both sides thereof, each medial land being of a trapezoidal cross section. The metal strip 12 is successively stamped or coined so as to be provided with a series of coupling heads 16 (FIG. 1).

Figure 4:
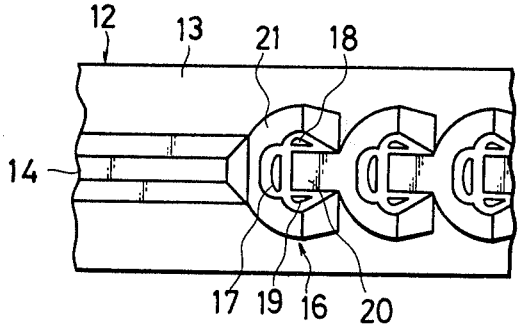
FIG. 4 is an enlarged fragmentary plan view of a portion of the metal strip shown in FIG. 1.
Figure 5:
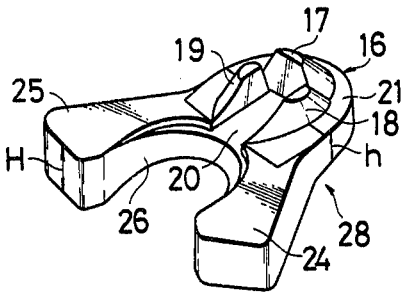
FIG. 5 is an enlarged perspective view of a coupling element produced in accordance with the present invention.
Figure 6:
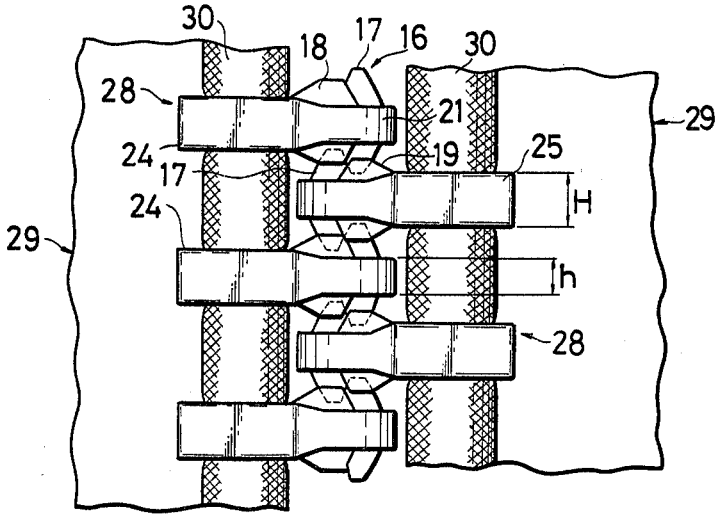
FIG. 6 is an enlarged fragmentary plan view of a pair of slide fastener stringers having coupling elements as illustrated in FIG. 5.

In FIGS. 4 and 5, each coupling head 16 includes on each side thereof a transverse projection 17 located centrally of the strip 12 and a pair of longitudinal teeth 18,19 disposed one on each side of and contiguous to the projection 17, the projection 17 being higher than the teeth 18,19 as best illustrated in FIG. 6. The projection 17 and teeth 18,19 are formed substantially by deforming the medial lands 14,15 during stamping. The projection 17 and the teeth 18,19 jointly define a pocket 20. A horseshoe-shaped base 21 extends around the projection 17 and the teeth 18,19. A portion of the strip 12 which includes the pocket 20 and the base 21 that extend all the way around the projection 17 and the teeth 18,19 has a thickness h smaller than the thickness H of the web 13. During stamping, material flows from the pocket 20 and base 21 into the projection 17 and teeth 18,19, whereby the projection 17 and teeth 18,19 have their required projection heights.

Then, the marginal edges of the web 13 are successively cut out to form notches 23 that serve to define outer profiles of clamping legs 24,25, as shown in FIG. 1. Thereafter, the metal strip 12 thus coined is severed by punching into an individual coupling element 28 (FIG. 2) having a concave edge 26 defining the inner profile of the clamping legs 24,25 and a convex edge 27 defining the outer profile of the coupling head 16. The thickness of the clamping legs 24,25 remains the same as the thickness H of the web 13.

Figure 2:
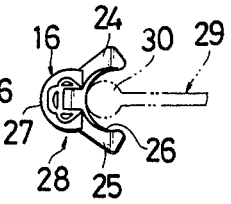
FIG. 2 is a plan view of a coupling element before being attached to a beaded tape edge.

The coupling element 28 is attached to a stringer tape 29 by clinching the legs 24,25 around a beaded edge 30 of the stringer tape 29 (FIGS. 2 and 6).

Figure 7:
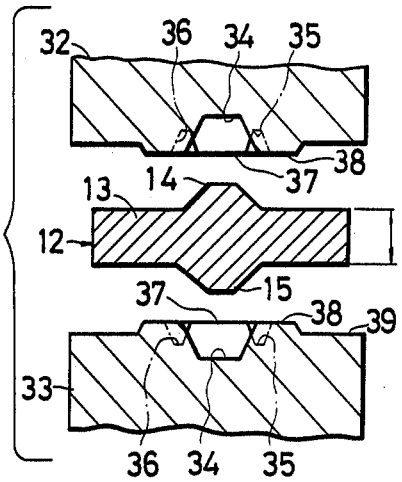
FIGS. 7 and 8 are enlarged cross-sectional views of the metal strip before being stamped between dies, the views showing different die cross-sections.
Figure 8:
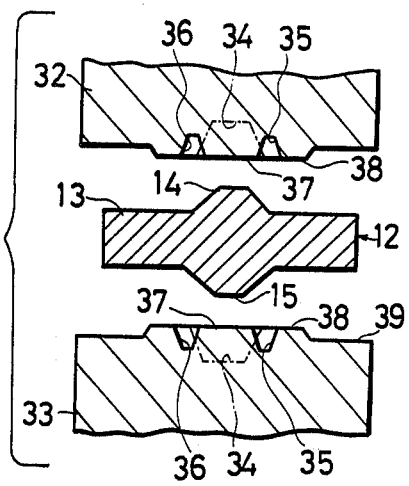
Figure 9:
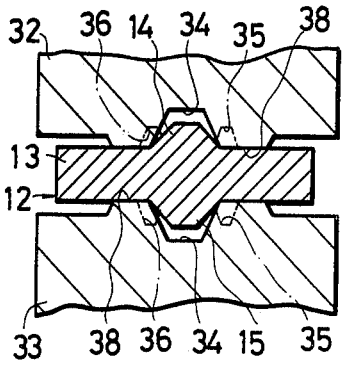
FIGS. 9 and 10 are enlarged cross-sectional views of the metal strip as it is being stamped between the dies, the views showing different die cross-sections.

FIGS. 7 and 8 show a punch press including a pair of upper and lower dies 32,33 for stamping or coining the metal strip 12 longitudinally fed therebetween. Each of the dies 32,33 includes a central recess 34 and a pair of spaced side cavities 35,36 extending respectively transversely and longitudinally of the direction of feed of the metal strip 12, the central recess 34 being deeper than the side cavities 35,36. The side cavities 35,36 are located one on each side of the central recess 34 in communication therewith. A central pressing surface 37 lies between the spaced side cavities 35,36 and adjacent to the central recess 34. A pressing surface 38 which is horseshoe-shaped though not shown extends around the recess 34 and side cavities 35,36 in surrounding relation to the central pressing surface 37. The pressing surfaces 37,38 are raised with respect to a surface 39 of each die 32,33 so that the pressing surfaces 37,38 on the dies 32,33 coact with each other to press the metal strip 12.

Figure 10:
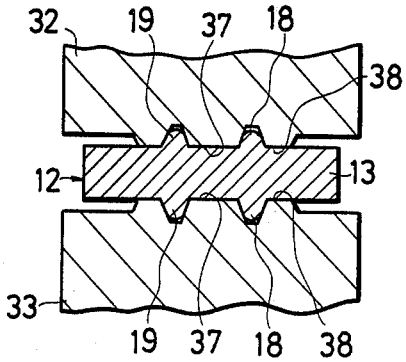

More specifically, the metal strip 12 is first advanced longitudinally between the upper and lower dies 32,33 with the medial lands 14,15 being held in complete vertical registry with the upper and lower recesses 34,34, respectively and in partial vertical registry with upper and lower side cavities 35, 36, respectively. Upon stoppage of the metal strip 12, the upper and lower dies 32,33 move relatively toward each other to press the metal strip 12 therebetween. The medial lands 14,15 starts being squeezed into the upper and lower recesses 34,34, respectively. Since the side cavities 35,36 are located partly above and below the medial lands 14,15 and communicate with the recesses 34,34, a portion of the medial lands 14,15 is also squeezed into the cavities 35,36. The central pressing surfaces 37,37 press an adjacent portion of the medial lands 14,15, which flows into the recesses 34,34 and the side cavities 35,36 (FIG. 10). As the upper and lower dies 32,33 are further pressed toward each other, the central pressing surfaces 37,37 and the horseshoe-shaped pressing surfaces 38,38 are thrust into the web 13 to form the thinned pockets 20,20 and the horseshoe-shaped bases 21,21 in both sides of the strip 12. At this time, material flows from the pockets 20,20 and the horseshoe-shaped bases 21,21 into the recesses 34,34 and the side cavities 35,36, whenupon the projections 17,17 and the teeth 18,19 are completely formed. Since a substantial amount of metal flow is squeezed into the recesses 34,34 and cavities 35,36, the web 13 does not expand widthwise by being pressed between the upper and lower dies 32,33. Accordingly, the thickness of the clamping legs 24,25 remains the same as the thickness H of the web 13.

As best illustrated in FIG. 6, the projections 17 and the teeth 18,19 of each of the coupling elements 28 thus produced have a large projection height for secure and reliable interdigitating engagement between coupling elements 28,28 on opposed stringer tapes 29,29. Nonetheless, the clamping legs 24,25 have a minimum thickness such that they are securely clamped on the beaded edge 30 and, at the same time, allow smooth sliding movement of a slider thereon. As part of the material of the projections 17,17 and the teeth 18,19 is available by thinning down the base 21, the medial lands 14,15 and hence the web 13 need not originally be thick. Accordingly, material saving can be achieved in accordance with the method of the present invention.

Although a certain preferred embodiment has been shown and described in detail, it should be understood that changes and modifications may be made therein without departing from the scope of the appended claims.

What is claimed is:

1. A method of manufacturing slide fastener coupling elements, comprising the steps of:

(a) advancing a metal strip, comprised of an elongate web and an upper and a lower longitudinal medial land each disposed on an opposite side of the web, longitudinally between a pair of upper and lower dies each having a central recess and a pair of spaced side cavities spaced on opposite sides of the central recess;

(b) stopping the metal strip with the upper and lower longitudinal medial lands located in complete vertical registry with the central recesses of the upper and lower dies, respectively, and with the side cavities of the upper and lower dies disposed transversely on opposite sides of the centers of and in partial vertical registry with the upper and lower longitudinal medial lands, respectively;

(c) stamping the metal strip between the upper and lower dies to deform a portion of each of the medial lands into a transverse projection and a pair of spaced longitudinal teeth one on each side of the transverse projection with a pocket portion formed in the metal strip surrounded by the transverse projection and teeth and with a base extending around the transverse projection and teeth, said pocket portion and base being formed thinner than the metal strip web, and said transverse projection and teeth being formed partly of material squeezed from the pocket portion and base;

(d) blanking outer profiles of coupling element legs out of marginal edges of the metal strip web; and (e) thereafter, blanking out of the metal strip a coupling element including said transverse projection and teeth and said legs.

2. A method according to claim 1, wherein the step of stamping the metal strip is effective to form said transverse projection higher than said teeth.

* * * * *